US011939138B1

(12) United States Patent
Chang et al.

(10) Patent No.: US 11,939,138 B1
(45) Date of Patent: Mar. 26, 2024

(54) FACIAL TISSUE BOX WITH ADJUSTABLE HEIGHT

(71) Applicants: Kevin Chang, Fullerton, CA (US); Keun-Ho Chang, Daejeon (KR)

(72) Inventors: Kevin Chang, Fullerton, CA (US); Keun-Ho Chang, Daejeon (KR)

( * ) Notice: Subject to any disclaimer, the term of this patent is extended or adjusted under 35 U.S.C. 154(b) by 0 days.

(21) Appl. No.: 18/127,971

(22) Filed: Mar. 29, 2023

(51) Int. Cl.
*B65D 83/08* (2006.01)
*B65D 5/36* (2006.01)
*B65D 5/42* (2006.01)

(52) U.S. Cl.
CPC ..... *B65D 83/0835* (2013.01); *B65D 5/3635* (2013.01); *B65D 5/4204* (2013.01); *B65D 5/4266* (2013.01); *B65D 2583/082* (2013.01)

(58) Field of Classification Search
CPC ..... B65D 83/0823; B65D 83/0817; B65D 21/08; B65D 5/4204; B65D 2583/082; B65D 5/005; B65D 5/3635; B65D 5/4266; B65D 83/0835; A47K 10/427
USPC ..... 206/776, 769, 233; 229/101, 101.2
See application file for complete search history.

(56) References Cited

U.S. PATENT DOCUMENTS 1,950,104 A * 3/1934 Ewers ..... B65D 5/067 229/101
2,566,016 A * 8/1951 Cochran ..... B65D 83/0888 220/684
2,598,050 A * 5/1952 Guyer ..... B65D 5/5007 221/63
3,224,633 A * 12/1965 Dayton ..... B65D 5/0005 221/48
3,313,467 A * 4/1967 Anderskow ..... B65D 5/0005 229/101
3,598,303 A * 8/1971 Folz ..... B65D 5/22 229/101
4,238,068 A * 12/1980 Ellerbe ..... B65D 5/106 229/101
5,065,936 A * 11/1991 King ..... B65D 5/0005 229/101
5,390,820 A * 2/1995 Wright ..... B65D 83/0811 221/56

(Continued)

FOREIGN PATENT DOCUMENTS

EP 1770026 A2 * 4/2007 ..... B65D 5/0005
WO WO-2022260671 A1 * 12/2022

*Primary Examiner* — Chun Hoi Cheung
(74) *Attorney, Agent, or Firm* — Averill, Green & Kim; Philip Y Kim; Kenneth L. Green

(57) ABSTRACT

A tissue box comprising front and rear surfaces including horizontal fold lines; a left end surface including a horizontal fold line and a vertical perforation line; a right end surface including a horizontal fold line and a vertical perforation line; a top surface including a tissue pull-out-port; a bottom surface including a horizontal perforation line at the center of said bottom surface and vertical perforation lines at either end; lock keys form in said bottom surface so that said left end surface and right end surface can tuck in said lock keys; and said front surface, rear surface, left end surface, right end surface, top surface, and bottom surface all foldably connect to form a rectangular box. By its construction, said tissue box height can be reduced to prevent the termination of the cascade pulling mechanism when the remaining number of tissues in the box becomes half or less.

7 Claims, 4 Drawing Sheets

(56) References Cited

U.S. PATENT DOCUMENTS

| | | | | |
|---|---|---|---|---|
| 6,138,901 | A * | 10/2000 | Kim | B65D 5/0227 229/101 |
| 6,279,818 | B1 * | 8/2001 | Kim | B65D 5/0005 229/101 |
| 6,283,295 | B1 * | 9/2001 | Akutagawa | B65D 5/0005 221/56 |
| 6,364,199 | B1 * | 4/2002 | Rose | B65D 5/0005 229/101 |
| 6,676,009 | B1 * | 1/2004 | Rose | B65D 5/0005 229/101 |
| 7,070,089 | B2 * | 7/2006 | Kim | B65D 5/0005 229/101 |
| 2018/0208350 | A1 * | 7/2018 | Ertmer | B65D 5/0005 |
| 2018/0251289 | A1 * | 9/2018 | Poirier | B65D 83/0817 |
| 2020/0346815 | A1 * | 11/2020 | Esseny | B65D 83/0894 |

* cited by examiner

FACIAL TISSUE BOX WITH ADJUSTABLE HEIGHT

CROSS-REFERENCE TO RELATED APPLICATION

The present application claims the priority of Korea patent Application number: 10-2022-0122079 filed Sep. 27, 2022, which application is incorporated by reference in its entirely.

BACKGROUND OF THE INVENTION

The present invention relates to a cosmetic tissue box from which tissues pull out in a cascade. The invention involves an idea of a box design in which the box height is made reducible in order to prevent the termination of the cascade-pulling mechanism before the full use of the tissue box when the remaining number of tissues in the box becomes half or less.

A typical cosmetic tissue box is a cuboid cardboard box; a certain number of tissues are stacked and stored in overlap folds inside the tissue box. An outlet forms in the middle at the top face. And when a tissue pulls through the outlet, the tissue in the next layer overlapping with the former follows to the outlet. Therefore, the user can pull out the tissues continually in a cascade.

On the other hand, in certain tissue boxes, if the amount of tissue remaining in the box is less than half of the amount at the beginning, the connection of the tissues drawn out in the process of pulling out discontinues; the follow-up tissue does not come out but remains inside the box. This phenomenon occurs because a large gap forms inside the upper part of the tissue box. In this case, the user has to put fingers through the outlet into the box to grab the tissue and pull it out; this is very inconvenient.

The solution to this problem is to reduce the box height structurally when the tissues in the box are consumed by half or more.

If you apply this principle, you will have a marketable advantage by increasing the height of the box to some extent.

In the prior art, some patents exist. The inside vertical dimension of the tissue box could be reduced by raising the lower portion of the box such that it may be easy to pull out the tissue when the remaining amount of tissue stack becomes low. In this conventional method, however, since the original exterior size of the tissue box is maintained, and a portion of the bottom surface has to be elevated, the structure of the tissue box is complicated. It is difficult to manufacture, and the procedure of elevating the inner part is cumbersome.

BRIEF SUMMARY OF THE INVENTION

The present invention is to solve the problems associated with the cosmetic tissue box: pulling out tissues continuously in a cascade until the last sheet is consumed. And an object of the present invention is to reduce the height of the tissue box simply and quickly when the remaining amount of tissue stored in the box is half or less. The purpose is to provide a height-adjustable tissue box that shortens to make it easier to pull out the tissues.

According to the present invention for achieving the above object, folding lines and perforations are incorporated onto the tissue box surfaces; such a modified box is a height-reducible tissue box. In this box, an outlet forms on the upper surface; two horizontal fold lines form on the front and the rear surfaces; and the folding lines extend towards the left and the right surfaces to surround the box on all four faces. Four perforation lines form on the four edges from the folding line toward the bottom surface; perforations also form along the bottom edges of the left and right ends, and a horizontal lengthwise perforation line forms in the middle of the bottom surface, connecting the two perforations at the bottoms of the left and right ends.

Despite, the additions of fold lines and perforations to the original cuboid tissue box, the overall dimensions, and shape of the tissue box remain unchanged.

The shortening of the box height proceeds as follows: First, flip over the box so that the bottom surface faces upward. The remaining tissues are shifted downward due to their own gravity. Next, press into the perforations with fingers to tear the middle of the bottom surface and the box corners; the fold lines on the front, back, and end surfaces are exposed now; then fold the front (or the back) surface along the fold line, then fold the back (or the front) surface overlapping; afterward, fold the end surfaces inward covering over the front-rear-folded surfaces. On the new bottom surface, the ends of the folded-in left and right surfaces are held by two lock keys. The lock keys are simple semi-circle cuts formed on the bottom surface of the box.

In addition, a tissue window in the vertical direction forms on the upper portion of front or rear surface of the tissue box. The tissue window facilitates monitoring the amount of the remaining tissue in the box. A transparent film should be attached to the inside of the cutout of the tissue window.

In producing a properly proportioned tissue box, the width, and length of the front, rear, left, and right ends and bottom of the tissue box form to satisfy the following equations.

Here, (e) is the vertical length of the front and rear surfaces, (a) is the length of the hang-over that connects to the upper surface and folded to form a part of the left or right end, (c) is connected to the bottom and folded to form a part of the left or right end; (b) is the length of the portion extending from the front and rear surfaces to form the end surfaces; (f) is the horizontal width of the front and rear surfaces; (d) indicates the distances from the bottom of the box to the horizontal fold lines in the front and rear surfaces. The distance from the perforation line formed on the bottom surface to the lock key is (d1), as the height of the horizontal fold lines of the front and rear surfaces.

In addition, the horizontal fold lines formed on the front and rear surfaces of the tissue box satisfy the following equation from the bottom height.

Here, (e) is the height of the front and rear surfaces 10 and 20, (a) is the height of the hang-over 40*a* that connects to the top surface 50 and folded to form a part of the left or right end, (c) is connected to the bottom and folded to form a part of the left or right end; (b) is the length of the portion extending from the front and rear surfaces to form the end surfaces; (f) is the horizontal width of the front and rear surfaces; (d) indicates the distances from the bottom of the box to the horizontal fold lines in the front and rear surfaces. The distance d1 from the perforation line formed on the bottom surface to the lock key is, as the height of the horizontal fold lines of the front and rear surfaces.

In addition, the horizontal fold lines formed on the front and rear surfaces of the tissue box satisfy the following equation from the bottom height.

Here, (f) is the width of the top and bottom surfaces, and (e) is the height of the front and rear surfaces.

According to the present invention, the tissue box may transform into a reduced-height box in a few simple steps. When the user pulls out the tissues from the tissue box, and the remaining amount is less than half, and the box height becomes short, it prevents the ending of a cascade pull-out mechanism and allows the tissues to be pulled out continually in a cascade.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or typically within 10 percent of a stated value.

Figure 1:
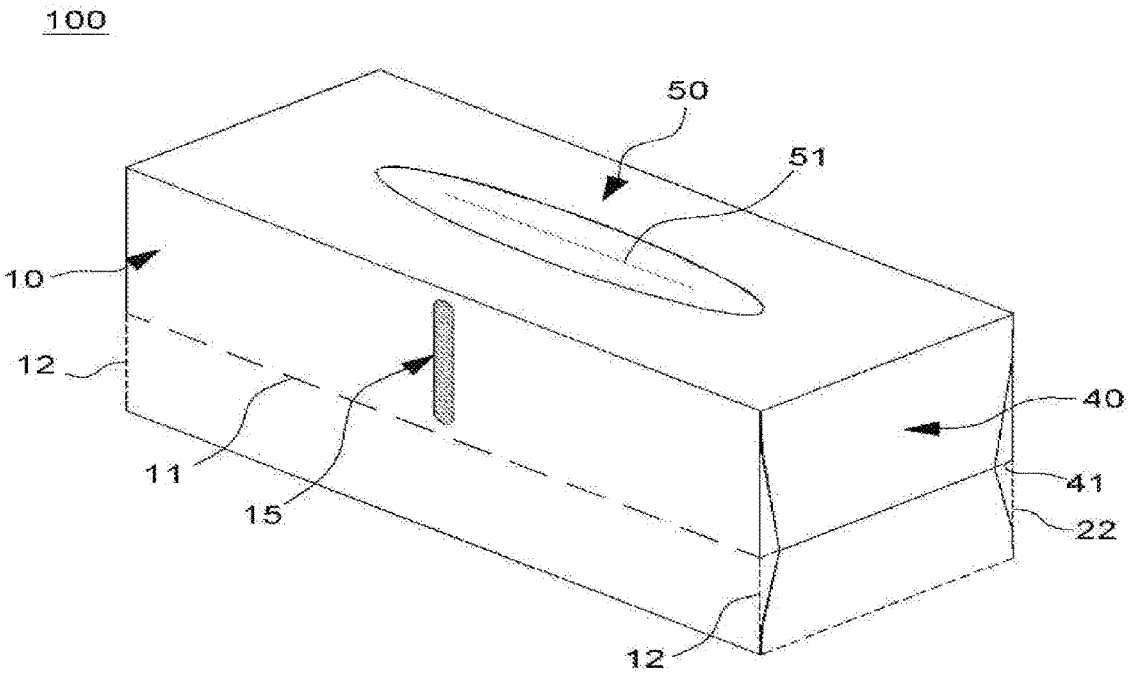
FIG. 1 is a front perspective view of a tissue box according to the present invention.
Figure 2:
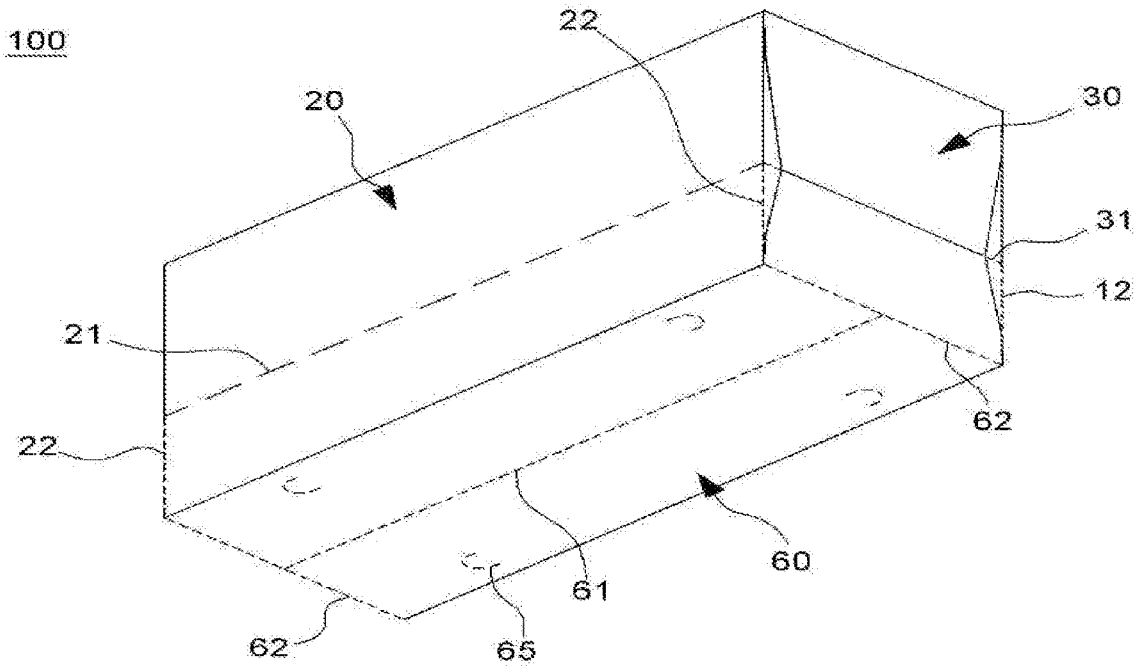
FIG. 2 is a rear perspective view of a tissue box according to the present invention.

FIG. 1 is a frontal perspective view of a tissue box. FIG. 2 is a rear perspective view of the tissue box and FIG. 3 is an exploded view of the tissue box.

Figure 3:
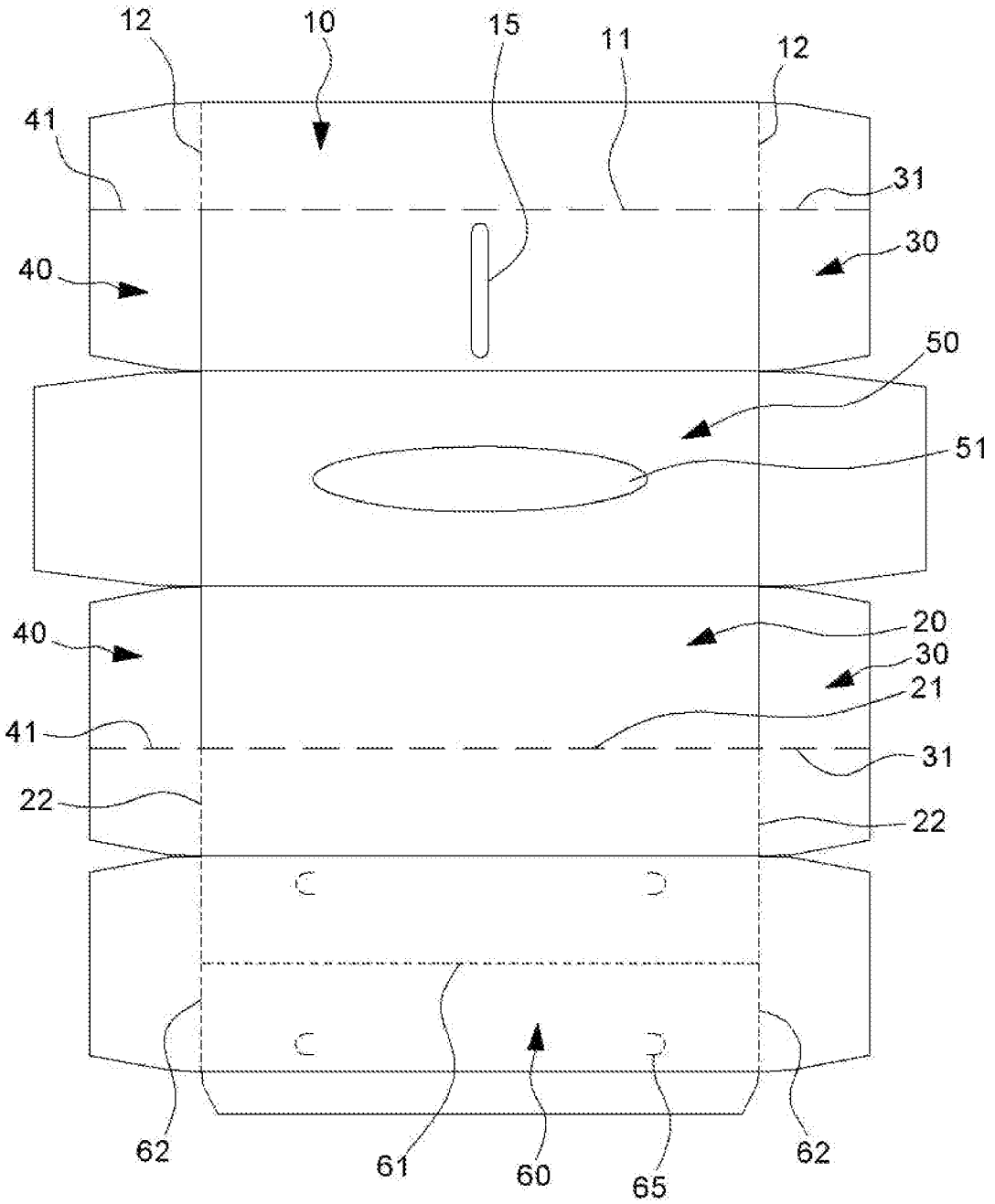
FIG. 3 is an exploded view of the tissue box according to the present invention.

FIGS. 1 through 3, show the tissue box (100), according to the present invention, has a rectangular cuboid shape like a tissue box and a pull-out-port (51) through which the tissue pulls out in the upper center. Inside the tissue box (100), a predetermined number of tissues are stacked and stored in an overlap-folded state.

A horizontal fold line (11) is formed on the front surface (10) of the tissue box (100) below the middle height, and at both ends where the horizontal fold line (11) ends, vertical perforation lines (12) are formed along corners below the fold line (11). A preferred fold line (11) is a line with intermittent cuts so that the user can easily bend it by hand; the perforation lines (12) are cut at regular intervals so that the user can easily tear it by hand. A tissue window (15) is provided on the upper portion of the horizontal fold line (11) formed on the front surface (10) of the cosmetic tissue box (100), and the tissue window (15) has cutouts extending vertically. It is possible to monitor the remaining amount of the tissues stored inside the tissue box (100). In an embodiment of the present invention, a transparent film such as vinyl is attached to the inside of the cutout of the tissue window (15) to prevent direct contact between the tissues and the exterior of the tissue box (100).

A horizontal fold line (21) forms on the rear surface (20) at the same height as the horizontal fold line (11). And at both ends of the horizontal fold lines (11) and (21), vertical perforation lines (12) and (22) form along the edges below the horizontal fold lines (11) and (21). In addition, horizontal fold lines (31) and (41) form at the same height as horizontal fold lines (11) and (21) on the left end surface (30) and the right end surface (40) of the tissue box (100).

On the bottom surface (60) of the tissue box (100), a horizontal perforation line (61) is formed in the middle in the lengthwise direction, and two end perforation line (62) are formed along the edges at both ends of the horizontal perforation line (61). Two pairs of locking keys (65) are incorporated on the bottom surface (60) so that the folded ends of the left end surface (30) and the right end surface (40) may tuck in. In the present invention, the cut-out shape of the lock key (65) is in the pattern of a "U".

The tissue box (100), configured above, would allow the decrease of its height by folding along fold lines and perforation lines formed on the box surfaces when the user pulls out enough tissues stored inside and the residual tissue observed through the tissue window (15) is less than half.

Figure 4:
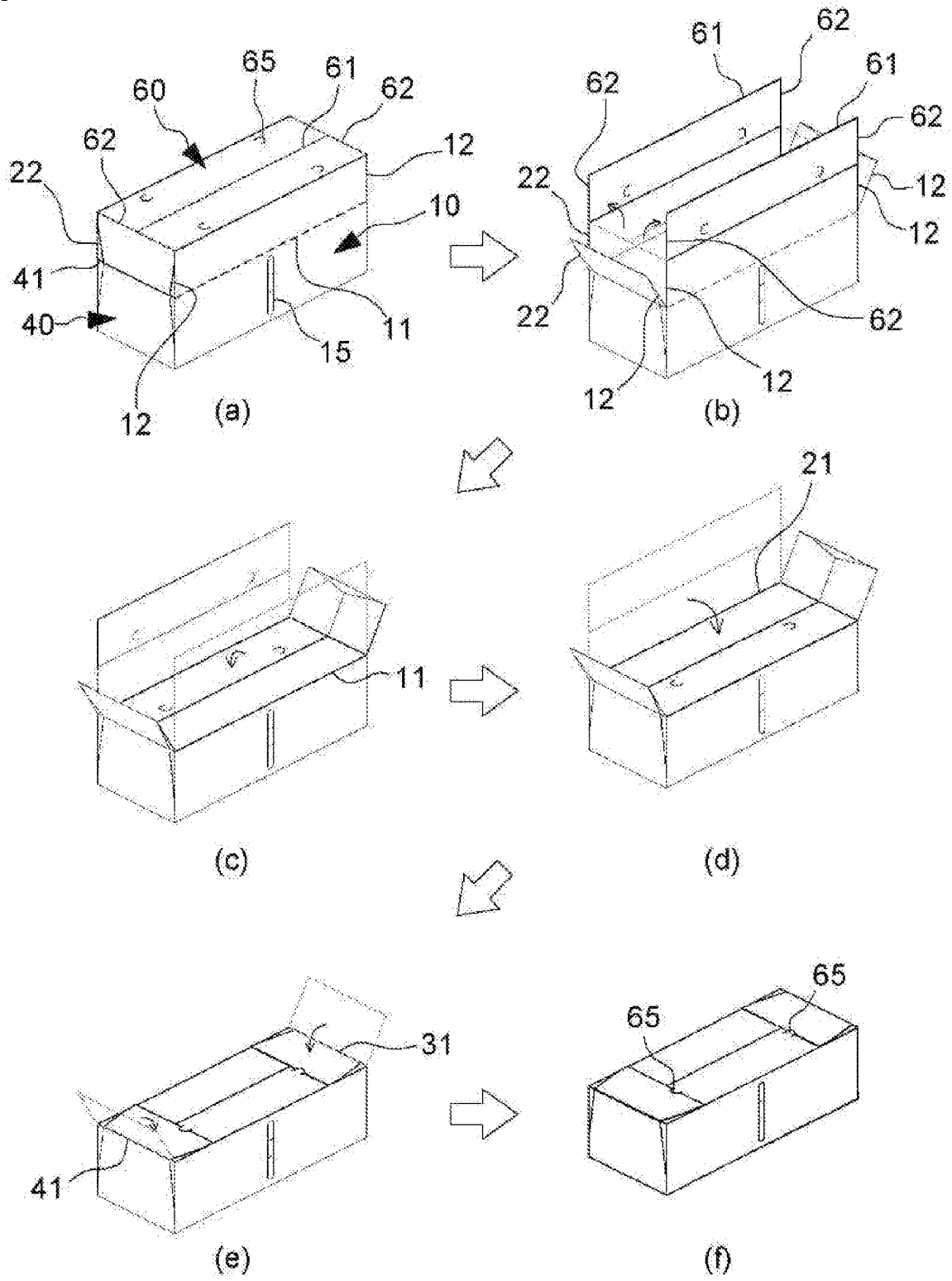
FIG. 4 is a flow chart showing the process of reducing the height of the tissue box according to the present invention.

FIG. 4 shows the process of reducing the height of the tissue box (100). The process is as follows: First, as shown in FIG. 4 (*a*), the tissue box (100) is turned upside down; the tissue stored inside sinks to the bottom by gravity, causing the underside of the bottom surface (60) remains more than half empty. Then, as shown in FIG. 4 (*b*), the horizontal perforations line (61), and the vertical perforation lines (12) and (22) are cut and spread open. Then, as shown in FIGS. 4 (*c*) and (*d*), fold along the horizontal fold lines (11) and (21); the folded parts are the cut-out front surface (10) and the cut-out surface of the bottom surface (60) extending from front surface (10), and the cut-out rear surface (20) and the cut-out surface of the bottom surface (60) extending from (20). The two folded faces overlap one on top of the other, as shown in FIG. 4(*d*).

As shown in FIG. 4 (*e*) and (*f*), the left end surface (30) and the right end surface (40) are folded inward of the box along the fold lines (31) and (41); the ends of the folded surfaces are tucked under the lock keys (65) to finish the modification of the box.

Figure 5:
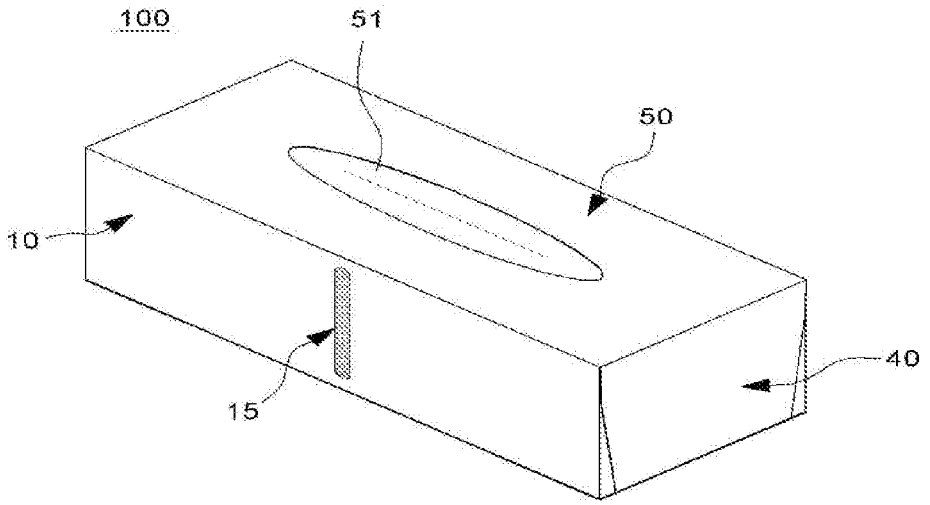
FIG. 5 is a perspective view of a tissue box whose height is reduced according to the present invention.

When the tissue box (100) reassembled through the above procedures is turned upside down, a new tissue box (100) with a reduced box height emerges, as shown in FIG. 5.

Figure 6:
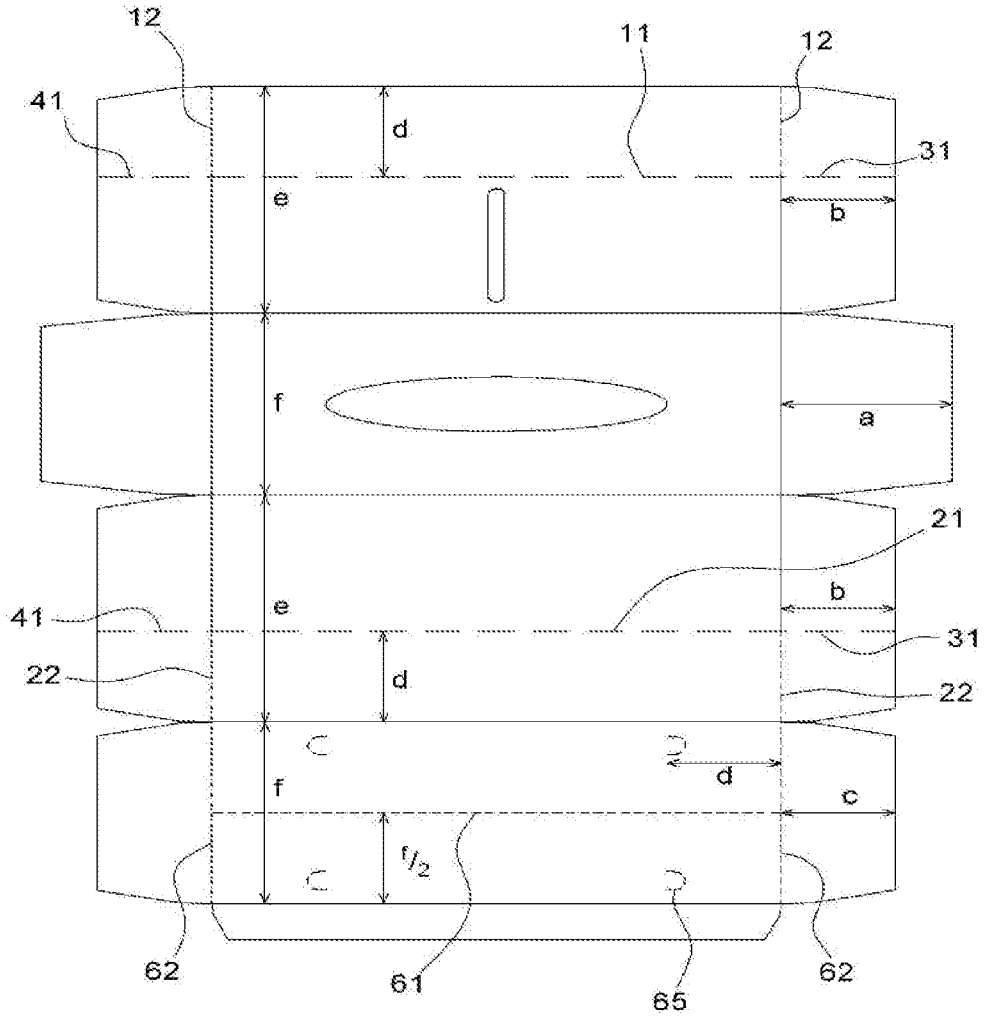
FIG. 6 shows an exploded view of the tissue box with code numbers according to the present invention.

FIG. 6 shows an example of an exploded view of a tissue box with code numbers according to an embodiment of the present invention. The modification of the height of the tissue box (100) entails folding and cutting the surfaces of the box. The dimensional relation is shown in equation 1 as follows: Equation 1:

$$e=a+c$$

$$b=f\times 1/2$$

$$d=c$$

Here, (e) is the height of the front surface (10) and the rear surface (20), (a) is the length (or height) of the portion (40*a*) connected to the top surface (50) and folded to form a part of the left end surface (30) or the right end surface (40). (c) is the length (or height) of the portion (40*b*) that connects to the bottom surface (60) and folds to form a part of the left end surface (30) or the right end surface (40); accordingly, the sum of the lengths (a) plus (c) is equal to the length of (e). That is, the lengths of the folded portions 40*a* and 40*b* are combined (a+c) to become the height (e) of the front surface (10) and the rear surface (20).

In addition, (f) is the width of the top surface (50) and the bottom surface (60); (b) is the length of a folded portion 20*a* at the ends of the back surface 20 and the length of a folded portion 10*a* at the ends of the front surface 10, (c) is the length of the portion (30*b*) which is a part of the left end (30) and the portion (40*b*) which is part of the right end (40) connected to the front surface (10) and the back surface (20) and folded respectively. The length (b) is % of the width (f) of the upper surface (50) and the bottom surface (60). (d) is the distance measured from the bottom surface (60) to the horizontal fold lines (11) and (21), and the length is the distance from the vertical perforation line (62) of the bottom surface (60) to the lock key (65).

Meanwhile, the height (d) of the horizontal fold lines (11) and (21) formed on the front surface (10) and the rear surface (20) satisfies the following equation.

$$d=\tfrac{1}{2}\times f,\ \text{if } e>f$$

$$d=\tfrac{1}{2}\times e,\ \text{if } e=f \qquad \text{Equation 2}$$

As in equation 2, in the present invention, the magnitude of (d) may vary depending on the width (f) and the height (e).

The front surface (10) and rear surface (20) fold along the horizontal fold lines (11) and (21) to form a new bottom surface. The new bottom surface (60) is in two layers. The left end surface (30) and the right end surface (40) fold along the horizontal fold lines (31) and (41). And the ends of the folded surface are tucked under the lock keys (65) formed on the bottom surface (60).

As such, in the present invention, horizontal fold lines (11), (21), (31), (41), and vertical perforation lines (12), (22), (32), (42), and (62) are formed on the tissue box surfaces. By cutting and folding along the perforations and folding lines, the height of the tissue box may be reduced; and solve the problem that the tissues do not come up in a cascade up to the last sheet of tissue.

On the other hand, the present invention is not limited to the above-described embodiments, and various modifications may be possible by those of ordinary skill in the technical field to which the present invention pertains within the scope of equivalents of the technical spirit of the present invention and the claims to be described below. And, of course, modifications may be made.

EXPLANATION OF CODE NUMBERS

100: tissue box
10: front surface
20: rear surface
11, 21, 31, 41: horizontal fold line
12, 22, 62: vertical perforation line
15: tissue window
30: left end surface
40: right end surface
50: top surface
51: pull-out port
60: bottom surface
61: horizontal perforation line
65: lock key While the invention herein disclosed has been described by means of specific embodiments and applications thereof, numerous modifications and variations could be made thereto by those skilled in the art without departing from the scope of the invention set forth in the claims.

We claim:

1. A tissue box comprising:
a front surface including a horizontal fold line;
a rear surface including a second horizontal fold line;
a left end surface including a third horizontal fold line and a vertical perforation line;
a right end surface including a fourth horizontal fold line and a second vertical perforation line;
a top surface including a tissue pull-out-port;
a bottom surface including a horizontal perforation line on said bottom surface and vertical perforation lines at opposite ends of the horizontal perforation line;
two pairs of lock keys formed in said bottom surface so that said left end surface and said right end surface can tuck in said lock keys; and
said front surface, said rear surface, said left end surface, said right end surface, said top surface, and said bottom surface all foldably connect to form a rectangular cuboid box.

2. The tissue box of claim 1, wherein said front surface further comprises a left and right end extending from the front surface, the rear surface further comprises a left and right end extending from the rear surface, the top surface further comprises a left and right end extending from the top surface, and the bottom surface further comprising a left and right end extending from the bottom surface.

3. The tissue box of claim 2 wherein the width and length of said front surface, rear surface, left end surface, right end surface, top surface, and bottom surface are formed to satisfy the following equation:

$$e=a+c$$

$$b=f/2$$

$$d1=c$$

Wherein "e" is the height of the front surface and the rear surface, "a" is the length (or height) of the top surface top surface left and right end and "c" is the length (height) of the bottom surface left and right end; "f" is the width of the top surface and the bottom surface, "b" is the length of the front surface left and right end; "d1" is the distance from the vertical perforation line of the bottom surface and to the lock key.

4. The tissue box of claim 1, wherein the height (d) of said horizontal fold lines on said front surface and said rear surface having a height pursuant to the following equation:

$$d=f/2,\ \text{if } e>f$$

$$d=e/2,\ \text{if } e=f$$

Wherein "e" is the height of the front surface and the rear surface, "f" is the width of the top surface and the bottom surface.

5. The tissue box of claim 1 further including a tissue window on said front surface or rear surface wherein said tissue window is above the horizontal fold line on said front surface or rear surface.

6. The tissue box of claim 5, further including a transparent film attached to an inside of the tissue window.

7. The tissue box of claim 1, wherein:

the bottom surface has a width and a length wherein the length is greater than the width; and the horizontal perforation line extends the length of the bottom surface.

* * * * *